US005274858A

United States Patent [19]

Berry

[11] Patent Number: 5,274,858

[45] Date of Patent: Jan. 4, 1994

[54] SHOWER SOAP SYSTEM

[76] Inventor: Gerald W. Berry, R.R. 1, Box 125, Maynard, Iowa 50655

[21] Appl. No.: 972,589

[22] Filed: Nov. 6, 1992

[51] Int. Cl.[5] ..... A47K 3/22

[52] U.S. Cl. ..... 4/605; 4/903; 239/314

[58] Field of Search ..... 4/567, 568, 570, 605, 4/628, 903; 239/10, 310, 314, 587.5, 587.6

[56] References Cited

U.S. PATENT DOCUMENTS

| | | | |
|---|---|---|---|
| 670,234 | 3/1901 | Hughen | 239/315 |
| 2,304,867 | 12/1942 | Wenker | 239/314 |
| 2,485,112 | 10/1949 | Rose | 239/314 |
| 2,625,430 | 1/1953 | Murphy | 239/314 |
| 2,647,797 | 8/1953 | Moss | 239/314 |
| 2,774,627 | 12/1956 | Johnson | 239/314 |
| 2,975,980 | 3/1961 | Siebert et al. | 239/310 X |
| 3,079,093 | 2/1963 | Bellows | 239/314 |
| 3,157,320 | 11/1964 | Sherriffe | 239/314 X |
| 3,180,579 | 4/1965 | Tomaso | 239/314 |
| 3,198,437 | 8/1965 | Faglie | 239/306 X |
| 3,226,034 | 12/1965 | Helman | 239/310 X |
| 4,081,139 | 3/1978 | Migliozzi | 239/314 X |
| 4,131,232 | 12/1978 | Pollinzi | 239/314 |

*Primary Examiner*—Henry J. Recla
*Assistant Examiner*—Robert M. Fetsuga
*Attorney, Agent, or Firm*—Zarley, McKee, Thomte, Voorhees & Sease

[57] ABSTRACT

A shower soap assembly is provided for mounting to a shower head fixture. The assembly has open opposite ends and soap holding screens mounted within for holding a cake of soap. When soap is desired, the housing is moved to a down soap loaded position such that water from the shower head nozzle passes through the housing dissolving the soap, and soapy water is dispensed through the output end. When soap is no longer desired, the housing is moved to an upright position out of the path of the stream of water.

6 Claims, 1 Drawing Sheet

SHOWER SOAP SYSTEM

BACKGROUND OF THE INVENTION

This invention relates to the field of accessories for a shower head assembly. Current shower assemblies provide a spray of only water. A person desiring a shower must take soap and apply it to the area to be washed, and then rinse the soap off in the shower head stream. A problem exists for applying the soap to areas which are not easily reached by persons, for example the middle back, or for elderly or handicapped persons who don't have the range of motion required to reach all areas of the body with soap.

An object of the present invention is to provide an accessory for attaching to a shower head which will dispense soap in the spray of water from the shower head, allowing for application of soap to "hard-to-reach places".

A further object of the invention is to provide a housing having soap holding screens mounted therein such that water passing through the housing will dissolve soap which is held in place by the screens.

Another object of the invention is to provide a simple device which may be detachably affixed to a shower head fixture, which will not interfere with the natural flow of water from the shower head.

Yet another object of the present invention is to provide a handle for easily moving the soap holder from the upright to the down soap loaded position.

A final object is to provide a water pressure release channel to allow water to by-pass the screens and blow through the housing in the event they become clogged with soap.

The method and means of accomplishing each of the above objects as well as others will become apparent from the detailed description of the invention that follows hereinafter.

SUMMARY OF THE INVENTION

A shower soap assembly is provided which is pivotally and detachably mounted to a shower head nozzle (8). The assembly (26) comprises a soap holder (12) which may be pivoted to a down loaded soap position (FIG. 1) where the holder (12) is aligned with the shower stream such that the stream passes through the holder (12) without any deflection or splashing, and soap being held within the holder (12) is dissolved. Thus the housing dispenses soapy water at the output end (28). The holder (12) may be pivoted to an upright position (FIG. 2) out of the shower stream when soap is no longer desired.

DETAILED DESCRIPTION OF THE INVENTION

Figure 1:
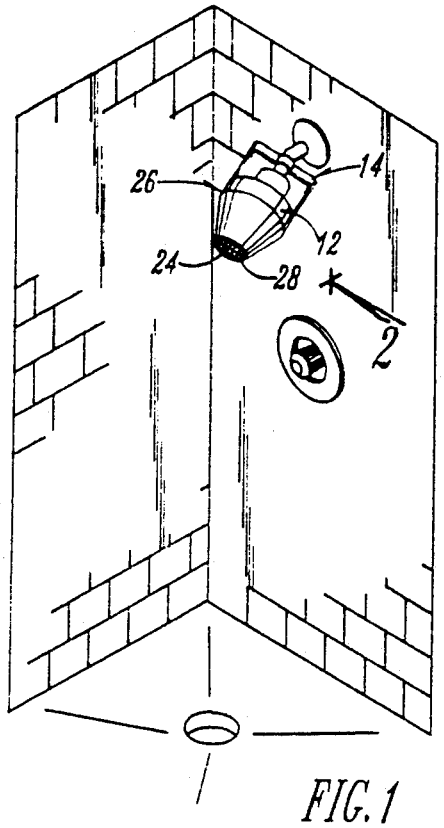
FIG. 1 is a perspective view of a traditional shower with the shower soap system attached to the shower head fixture. The soap holder is in the down soap loaded position.
Figure 2:
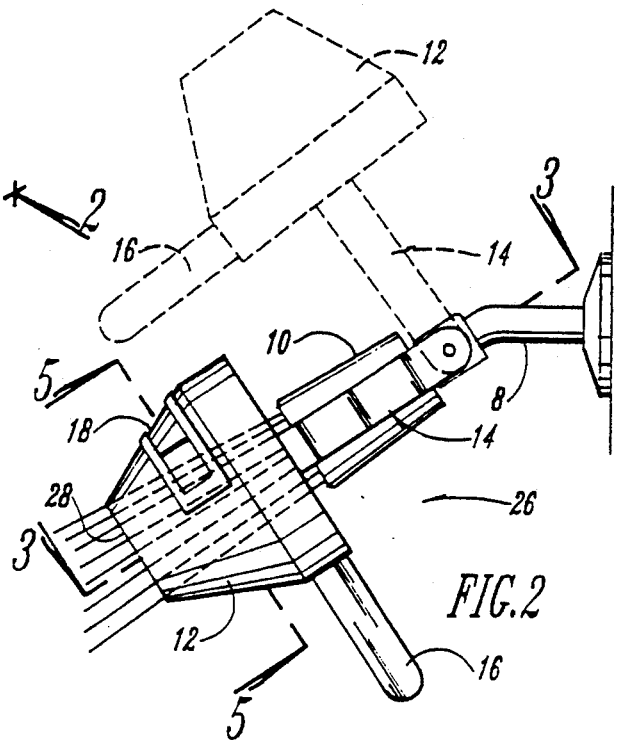
FIG. 2 is an elevated view of the soap holder attached to the shower head along line 2—2 of FIG. 1 illustrating movement of the system between the upright and down soap loaded position.
Figure 3:
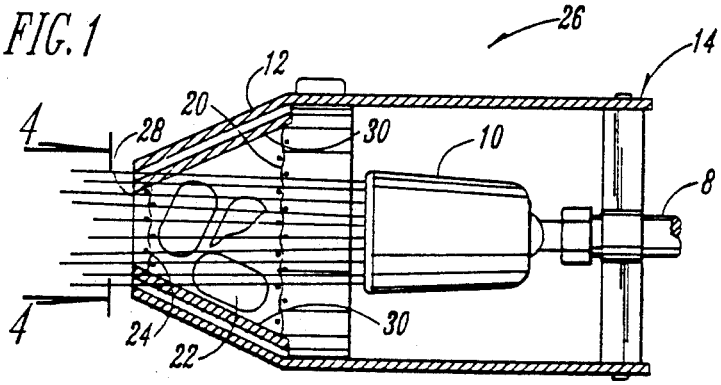
FIG. 3 is a cross sectional view in the plane of line 3—3 of FIG. 2.

More specifically, FIGS. 1-5 depict one embodiment of applicant's invention. For reference purposes, the figures, especially FIG. 2, show a conventional shower head (10). Mounted to the shower head is a soap holder housing (12). It is detachably mounted by means of a pivot frame (14). Handle (16) is used to move the soap holder housing (12) from an up position (FIG. 2) to a down soap loaded position (FIGS. 1, 2, and 3). Slot (18) is opened and soap is put into the soap holder housing (12).

Figure 4:
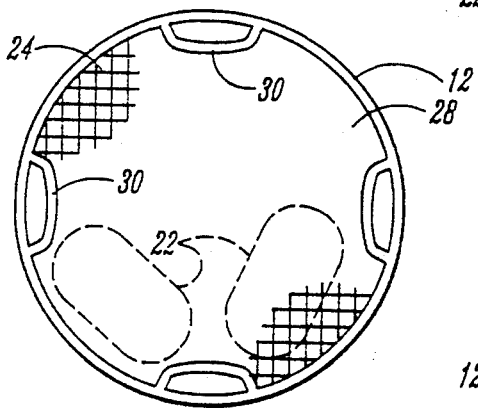
FIG. 4 is a view of the soap holder in the plane of line 4—4 of FIG. 3.
Figure 5:
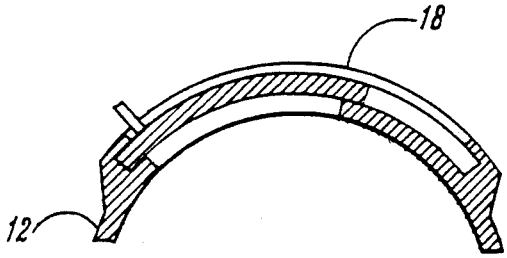
FIG. 5 is a view along the plane of line 5—5 of FIG. 3, illustrating the soap loading mechanism.

FIG. 3 shows a cross sectional view of the soap system showing a first soap holding screen (20). A second soap holding screen (24) is mounted at the output end (28). The screens (20/24) are mounted within the housing (12) to hold a cake of soap (22) within the soap holder housing (12), while letting the shower water stream pass through. The screens (20/24) should be of a mesh size small enough to hold the cake of soap (22) as it dissolves and large enough to let the shower stream pass through easily. FIG. 4 shows a bottom view of the soap holder (12). A pressure release channel (30) is formed by and along the sides of the housing such that water will still be able to pass through the housing (12) even if the soap (22) coagulates and clogs the screens (20/24).

When the soap holder (12) is in the down, or soap loaded position of FIG. 1 and the shower head (10) is activated, water sprays out of the shower head across the bars of soap (22) and out of the out put end (28)(FIGS. 1, 2 and 3). As a result, the water contacts the soap (22), dissolving it into the water stream and soapy water is sprayed directly onto the person showering. This invention allows for application of soapy water in difficult to reach places such as the middle of the back, etc. When the person is fully soaped, pivot handle (16) can be used to move the soap holder housing to the up position (FIG. 2) and fresh water is used to rinse.

What is claimed is:

1. A shower system for mounting to a shower head fixture; said system comprising:

(a) a housing having a continuous side wall portion with open opposite input and output ends; said input end being adapted for receiving water discharging from a shower head, said input end being of larger area than the shower head fixture;

(b) a means for pivotally mounting said housing to the shower fixture, said housing being movable between a first position, where said housing is outside of the shower head water stream and a second position, where said housing is within the water stream allowing the stream to pass therethrough, (c) a plurality of spaced apart soap screens affixed within the housing mounted generally perpendicular to the side wall portion of the housing for holding a cake of soap in the area between the spaced apart soap screens, said housing including a closable slot for loading soap between said soap screens.

2. The shower system of claim 1 wherein said housing includes a pressure release channel with open opposite ends, formed longitudinally within the sides of said housing.

3. A shower system for mounting to a shower head fixtures; said system comprising:

(a) a housing having a continuous side wall portion with open opposite input and output ends, said input end being adapted for receiving water discharging from a shower head, said input end opening being of larger area than the shower head fixture;

(b) a pivot frame having a pair of arms extending from a mounting means pivot point, said arms being fastened to the housing input end;

(c) a plurality of spaced apart soap screens affixed within the housing mounted generally perpendicular to the side wall portion for holding a cake of soap in the space between the spaced apart screens;

(d) a handle for moving the pivot frame between a first position where the housing is outside of the shower head water stream and a second position where the soap holder is within the water stream allowing the stream to pass therethrough;

(e) a pressure release channel with open opposite ends, formed longitudinally within the sides of said housing.

4. The shower system of claim 3 wherein said housing includes a closable slot for loading soap into said housing.

5. The shower system of claim 3 wherein said housing includes a pressure release channel with open opposite ends, formed longitudinally within the sides of said housing.

6. The pressure release channel of claim 5 wherein said soap holding screens afixed within the housing do not extend into the channel.

* * * * *